United States Patent [19]

Harris

[11] Patent Number: 4,674,379

[45] **Date of Patent: * Jun. 23, 1987**

[54] BIASED POWER FEED DEVICE HAVING MEANS TO REDUCE BIAS DURING ADJUSTMENT

[75] Inventor: Ivor R. Harris, Sandy, England

[73] Assignee: National Research Development Corporation, London, England

[ * ] Notice: The portion of the term of this patent subsequent to Jul. 16, 2002 has been disclaimed.

[21] Appl. No.: 799,982

[22] Filed: Nov. 20, 1985

Related U.S. Application Data

[63] Continuation-in-part of Ser. No. 751,435, Jul. 3, 1985, which is a continuation of Ser. No. 573,348, Jan. 24, 1984, Pat. No. 4,528,881.

[30] Foreign Application Priority Data

Jan. 26, 1983 [GB] United Kingdom ..... 8302123

[51] Int. Cl.[4] ..... B27B 5/22; B27B 5/29

[52] U.S. Cl. ..... 83/419; 83/422; 83/435.2; 144/242 R

[58] Field of Search ..... 83/435.2, 419, 431, 83/422; 144/242 R, 242 H, 242 K, 247, 248, 249 R, 249 A

[56] References Cited

U.S. PATENT DOCUMENTS 2,829,683 4/1958 Skinner et al. ..... 83/718

*Primary Examiner*—James M. Meister

*Attorney, Agent, or Firm*—Cushman, Darby & Cushman

[57] ABSTRACT

A device for feeding workstock to a saw blade. The device includes a friction drive adapted to engage a surface of the workstock to propel the same. The drive is mounted for a range of movement in a direction to accommodate workstock with varying dimensions. A gas spring holds the drive in any selected position within the range of movement and resiliently biases the same against movement away from that position. The gas spring includes a valve system which is operable at least to reduce the bias to facilitate selected adjustment of the drive and closable to hold the drive in a substantially fixed orientation throughout the range of movement.

13 Claims, 4 Drawing Figures

BIASED POWER FEED DEVICE HAVING MEANS TO REDUCE BIAS DURING ADJUSTMENT

This application is a continuation-in-part of application Ser. No. 751,435, filed July 3, 1985 which is a continuation of Ser. No. 573,348 filed January 24, 1984, now U.S. Pat. No. 4,528,881.

This invention relates to power feed devices for sawing machines or the like, that is to say to devices for propelling workstock to a saw blade or other power tool and especially timber to circular saws. Such devices not only promote good quality work and productivity by providing a constant feed rate of workstock and reducing operator fatigue, but also contribute to safety by obviating the need for hand-feeding of workstock.

Heretofore however power feed devices have been heavily built and have lacked versatility, particularly due to the fact that they were not readily capable of adjustment to suit workstock of varying dimensions. Consequently machinists have found it easier to feed workpieces by hand thus increasing the probability of an accident.

It is the object of this invention to provide a power feed device that may be swiftly and a easily adjusted.

According to this invention a device for feeding workstock to a saw blade or like power tool, comprises friction drive means adapted to engage a surface of the workstock to propel the same, means mounting the said drive means for a range of movement in a direction to accommodate workstock the dimensions of which vary in that direction, means to hold the said drive means in any selected position within the said range of movement and resiliently to bias the same against movement away from that position, means operable at least to reduce the bias to facilitate selected adjustment of the drive means and means automatically to maintain the drive means in a substantially fixed orientation throughout the said range of movement.

Preferably the means to hold the drive means and resiliently to bias the same comprise a gas spring and the means operable to reduce the bias provided by the spring comprise means operatively to interconnect the ends of the gas spring.

Desirably provision is made to effect lateral adjustment of the drive means when but only when the same are positioned clear of the saw blade or other tool.

In a preferred embodiment the drive means include a parallel pair of driven belts arranged to engage the workstock the drive means being arranged to be adjusted between at least two positions, one in which the drive belts are located to one side of a saw blade and a second position in which they straddle the same. For best results it has been found that along a part of their length first to engage workstock the belts should be set at an angle so as in use to direct workstock into contact with a fence associated with the saw blade.

Figure 1:
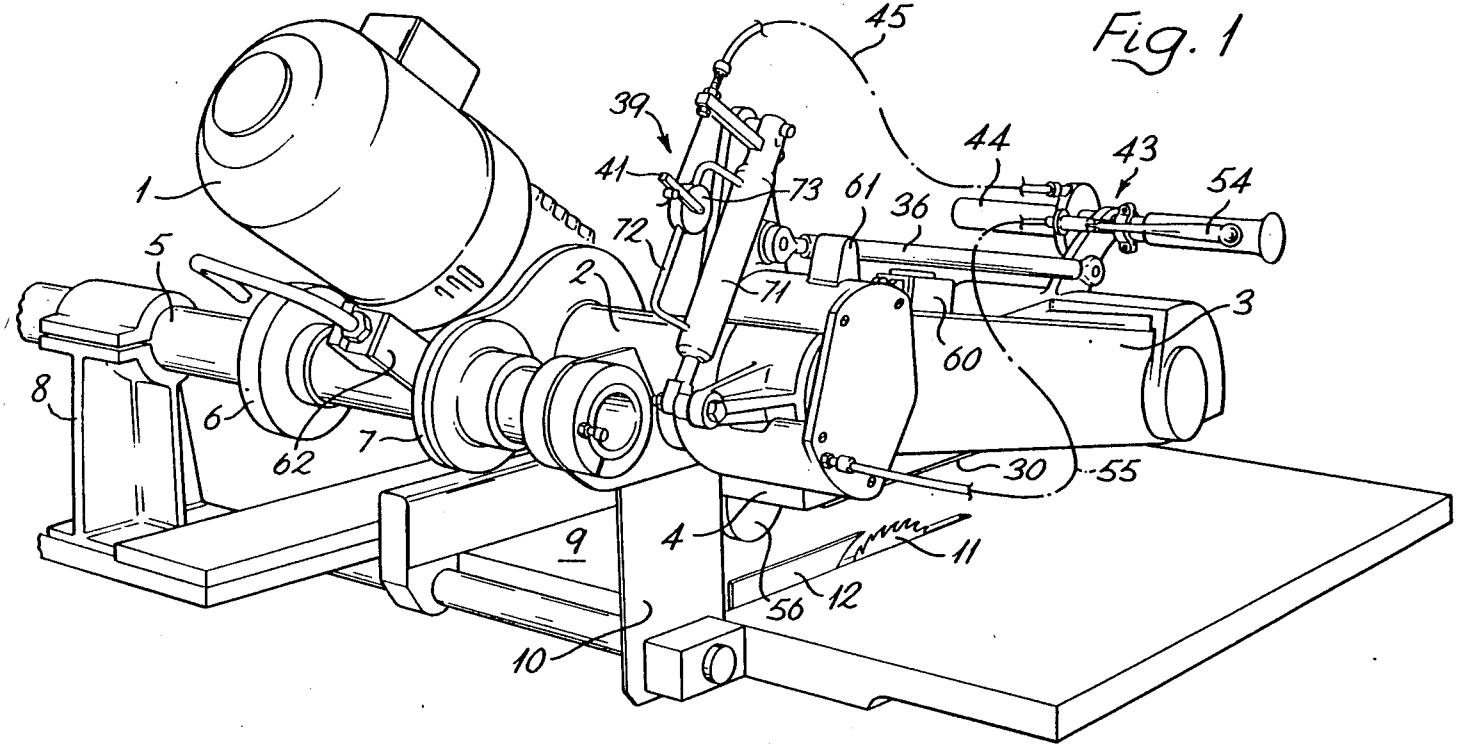
Figure 2:
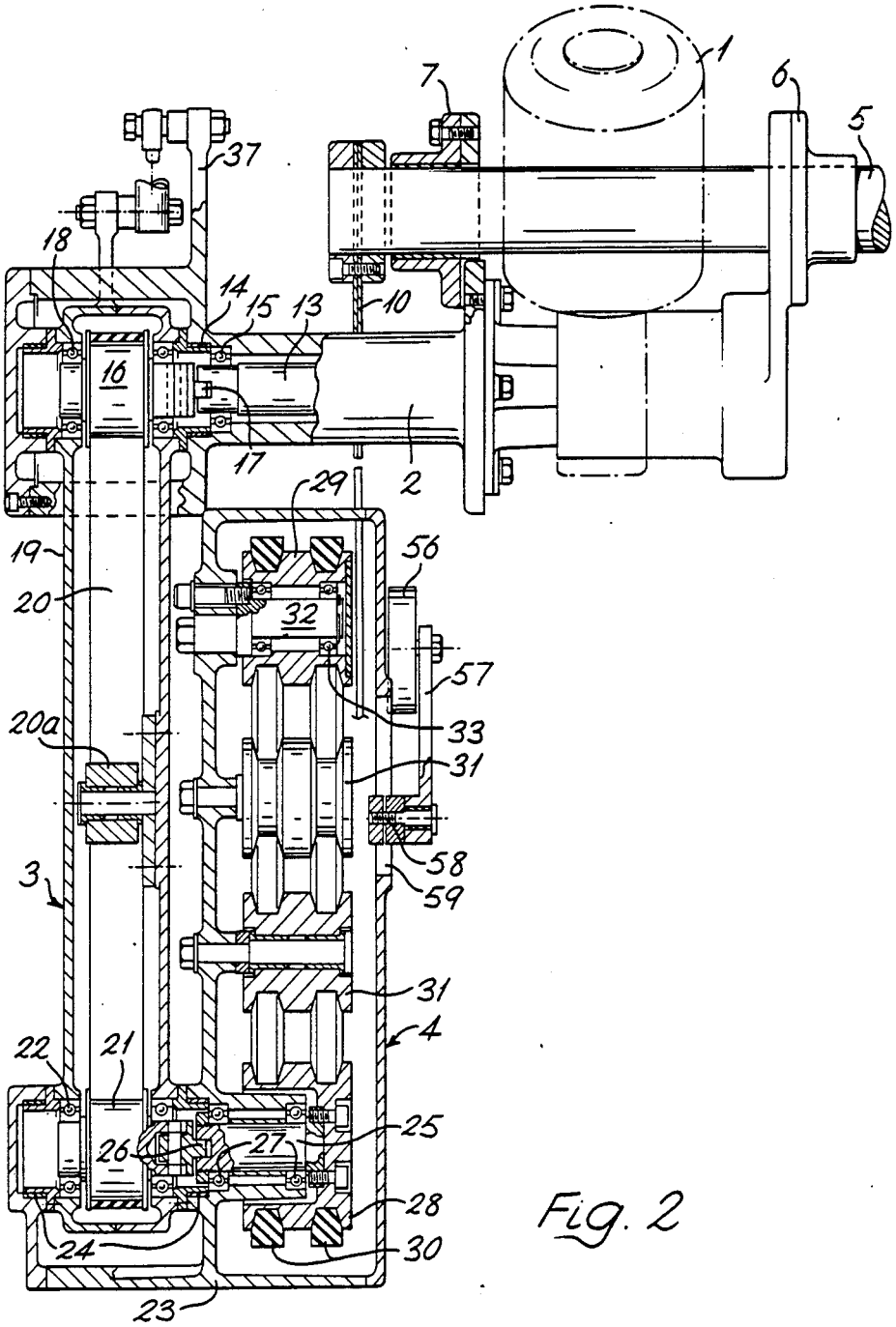
Figure 3:
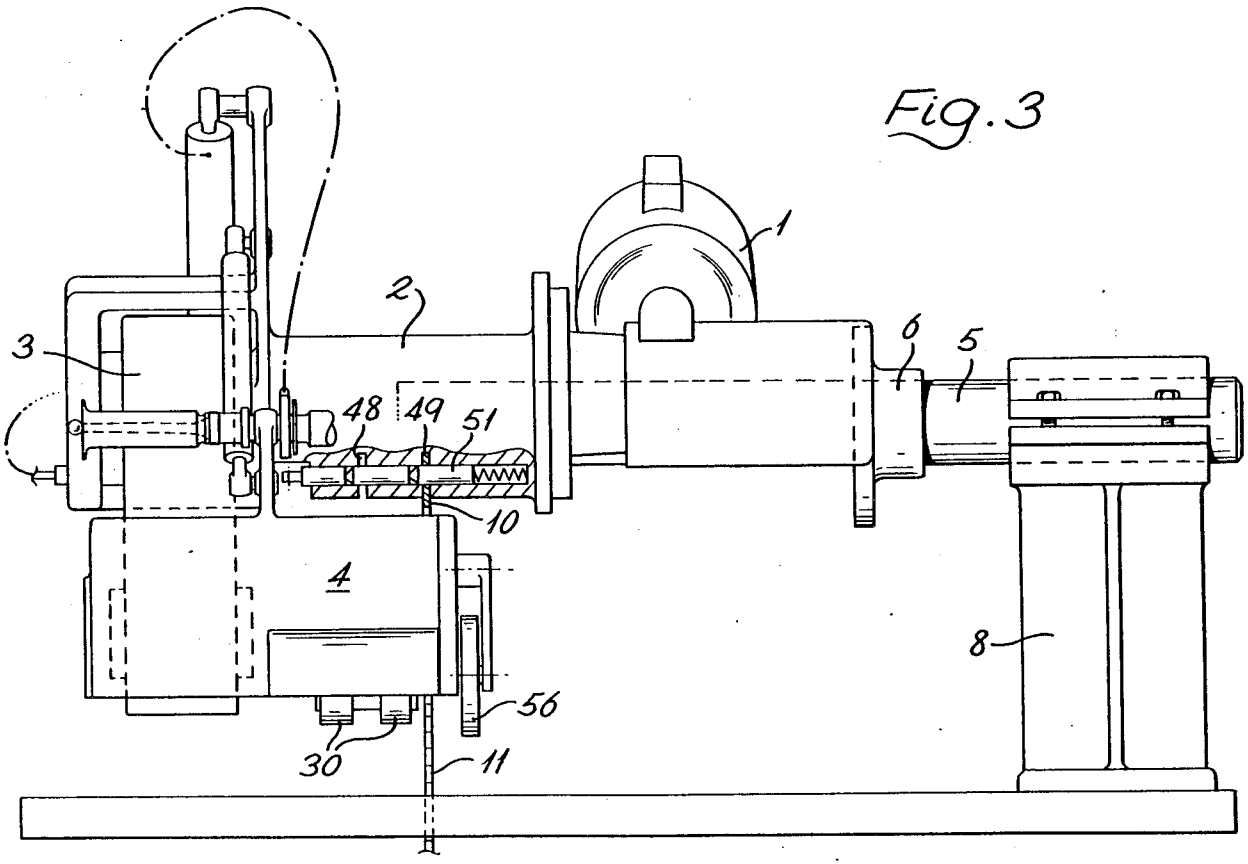
Figure 4:
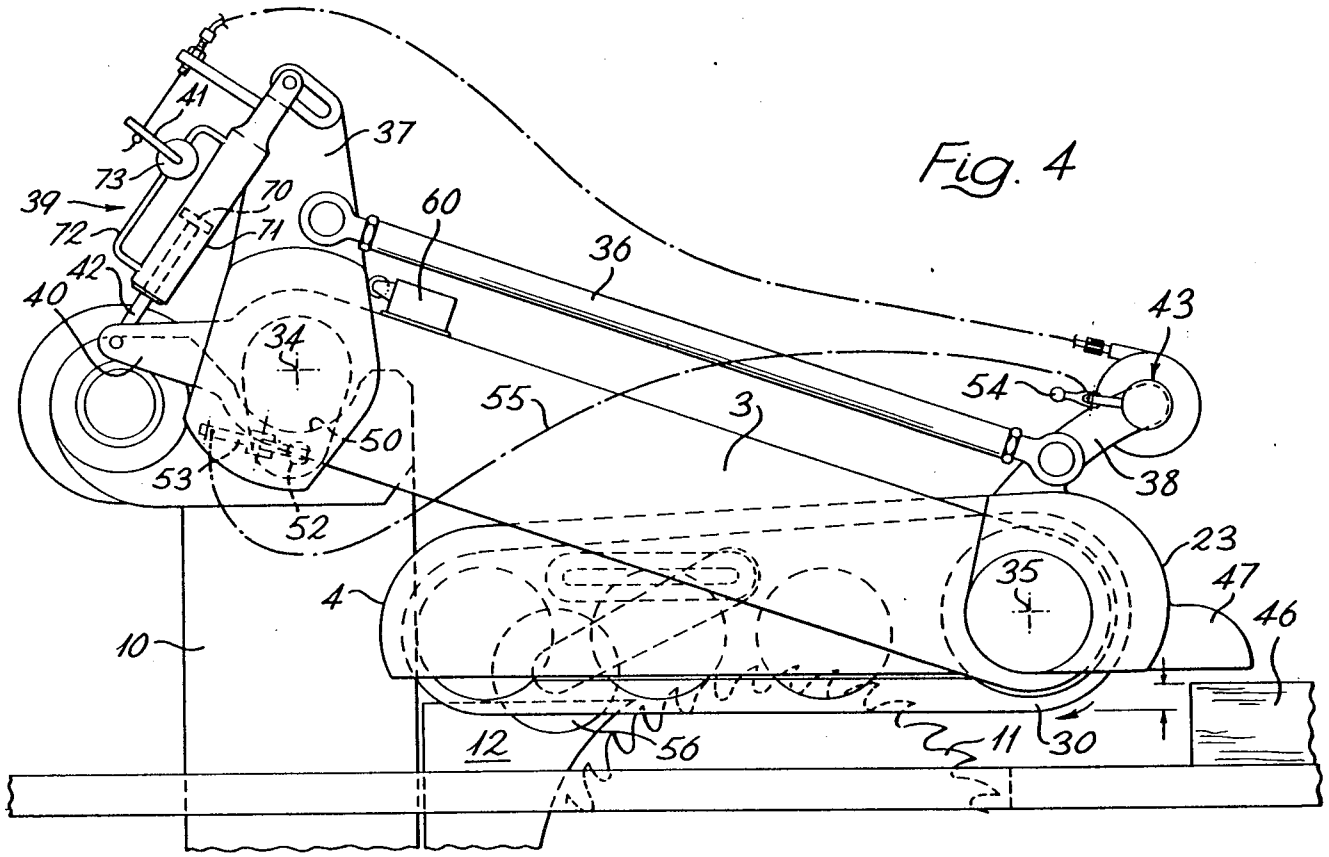

The invention is described below with reference to the accompanying drawings in which:

FIG. 1 is a perspective view of a power feed device in accordance with the invention, mounted on the bench of a circular saw, FIG. 2 is a part-sectional plan view of the device of FIG. 1, FIG. 3 is a front end elevation thereof, and FIG. 4 is a side elevation.

Referring to the drawings, a power feed device comprises a drive motor 1 coupled to a drive housing 2 on which a drop arm assembly 3 is mounted and which in turn carries a feeder head 4. The device is mounted on a horizontally extending support arm 5 by sleeve bearings 6 and 7, the support rod 5 being clamped to a support pedestal 8 mounted on the saw table 9. The support rod 5 is further supported by a plate 10 which is positioned on the saw table 9 in line with the saw blade 11 and its companion riving knife 12. The motor 1 is conveniently a geared electric motor and the drive shaft 13 (see FIG. 2) extending therefrom is contained within the housing 2 on which the drop arm 3 is pivotally mounted by trunnions 14. The shaft 13 is supported in bearing 15 and is connected to drive pulley 16 via a sliding coupling 17, the drive pully 16 in turn being mounted in bearings 18 located in the casing 19 which the drop arm 3 comprises. A toothed belt 20 contained within the casing 19 connects the drive pulley 16 to a driven pulley 21 supported by bearings 22 within the casing 19 in a similar manner to the pulley 16. The belt 20 may be tensioned by a jockey pulley **20*a*. The casing of the feeder head 4 is pivotally supported on the arm 3 by trunnions 24**.

A drive shaft 25 is coupled to the driven pulley 21 by a sliding coupling 26, the drive shaft 25 being located in bearings 27 seated in the feeder head casing 23. A drive wheel 28 is mounted on the drive shaft 25 and connected to a driven wheel 29 by a pair of V-belts 30 which are also supported by intermediate pressure rollers 31. The driven wheel 29 is mounted on an eccentric shaft 32 located by bearings 33, the eccentric shaft serving as means for adjusting the tension in the V-belts 30. The V-belts are preferably faced with high friction material (not shown). Natural rubber has proven to be efficacious. The rollers 31 enable the contact force that can be applied between the belts and a workpiece to be increased.

The trunnions 14 and 24 enable the drop arm and the feeder head to pivot respectively about the axes 34 and 35 (see FIG. 4) but the feeder head 4 is maintained in a constant orientation by a tie rod 36 extending between a bracket 37 fast with the drive casing 2 and a bracket 38 fast with the casing 23 of the feeder head 4, the tie rod 36 thus completing an effective parallelogram linkage system. The length of the tie rod 36 is conveniently made adjustable so as to enable the feeder head to be set in the desired spatial disposition which will normally be such that the V-belts 30 extend parallel to the surface of the saw bench, or if desired at a slight inclination thereto.

The combined weight of the drop arm 3 and feeder device 4 is counterbalanced by a gas spring device 39 extending between the bracket 37 and an arm 40 fast with the casing of the drop arm 3. The gas spring device is connected to no source of gas power but comprises a piston 70 mounted on a rod 42 within a cylinder 71, opposite ends of which are connected by a conduit 72 containing a valve 73 which is operable by a lever 41 and opening of which operatively interconnects the ends of the cylinder 71 so that the differential force across the piston of the gas spring provides a force on the piston rod 42. This force will normally be insufficient to lift the feeder head assembly but will be such as to reduce the additional effort required to lift the assembly to a level well within the capacity of the operator. With the valve closed the piston is pneumatically locked in position requiring a substantial force to move it in either direction, which force is selected to be more than adequate to balance the weight of the drop arm and feeder device so as to hold the latter in its desired set position.

It will be noted that by arranging only for movement of the drop arm 3 the feeder head 4 to effect vertical adjustment, the weight of the motor 1 and its associated gearing and transmission does not have to be contended with. Furthermore the distribution of the weight of the motor and associated parts in relation to the support rod 5 is such that the whole assembly may be rotated about the rod 5 without great effort. Balance weights may of course if desired be provided to facilitate either the vertical adjustment of the feeder head 4 or rotation of the whole assembly.

The assembly is arranged to be vertically adjustable by means of a handle 43 mounted on the bracket 39. The grip 44 of the handle is conveniently in the form of a twist grip connected via a Bowden cable 45 to the lever 41 of the gas spring. Upon operation of this lever the device can readily and swiftly be vertically moved to any position within its designed range of movement, the device being held in the selected position upon release of the lever 41.

In use the feeder device will normally be placed in a position such that the bottom surface of the device belts 30 is at a level below the top surface of a workpiece offered to them. A workpiece such as that indicated at 46 in FIG. 4 will be manually pushed against the drive belts 30 to enable the latter to grip the workpiece and cause it to be fed across the machine table to the saw blade 11. As a result of the feeder device being initially set at a height such that the drive belts 30 are set at a distance (such as indicated by the arrows in FIG. 4) below the top surface of the workpiece, as the latter is gripped by the drive belts the feeder head 4 will be forced upwards against the internal pressure of the gas spring 39 which thus provides the necessary downward force to enable the belts 30 to traverse the workpiece through the saw.

To simplify setting of the feeder head a rearwardly extending nose 47 is provided on the casing 23, the under surface of the nose being at a predetermined distance (for example 20 mm) above the contact surfaces of the belts 30. Then to set the feeder head for any particular workpiece only entails releasing the gas spring valve by turning the twist grip 44 and lowering or raising the head until the nose 47 rests on the upper surface of the workpiece. The nose additionally serves as a barrier to keep the operator's fingers from the drive belts 30.

In addition to being vertically adjustable provision is also made for the feeder device to be laterally adjusted. Although this adjustment may be between a greater number of positions, in the embodiment illustrated it is between two positions, one in which the feeder head 4 is so disposed that the saw blade 11 is located between the pair of drive belts 30 and a second position in which the saw is disposed to one side of the drive belt which is the position illustrated in FIGS. 2 and 3. As best seen in FIG. 3 the drive housing 2 is provided with a pair of curved locating slots 48 and 49 which are arranged to be alternatively mated with a complementary curved surface 50 (see FIG. 4) formed in the upper surface of the support plate 10. When in either one of the two locations thereby provided, the housing 2 is locked to the plate 10 by means of plungers 51 slidably mounted within the housing 2 and which engage an aperture 52 provided in the plate 10. The plungers 51 are biased into engagement with the aperture 52 and are arranged to be moved against the bias by a rocker 53 conveniently operable by a caliper 54 mounted on the handle 43 and connected to the rocker by a Bowden cable 55. When the plungers 51 are disengaged from the plate 10 the whole assembly may be pivoted about the support rod 5 to the extent necessary to disengage the plate 10 from a locating slot where after the whole assembly may be slidden along the support rod 5 to bring the plate 10 into registry with the other locating slot. It will be noted that unless the plate 10 is brought into registry with a locating slot it prevents the assembly from being lowered so that it is not possible to mis-align the assembly.

When the feeder head 4 is positioned such that the saw blade 11 is located between the belts 30 then both the stock material and the cut-off component will be fed thereby past the saw. This will not be the case when the feeder head 4 is positioned to one side of the saw blade, and to avoid any possibility of the cut-off piece moving back towards the operator a roller 56 is provided mounted on the arm 57 which is secured by a pivot 58 slidable for optimum positioning in a slot 59 formed in the casing 23 of the feeder head 4. The weight of the roller 56 resting on a cut-off piece is sufficient to hold the same. When not required the roller may be swung upwardly out of the way.

A safety switch 60 (see FIG. 4) mounted on the arm 3 is operated when it touches an abutment 61 (see FIG. 1) upon raising of the arm 3. Likewise a safety switch 62 (see FIG. 1) is operated when the feed device is moved between its two operating positions, the function of the switches being to switch off power to the motor 1 and/or to the saw blade should it be dangerously exposed.

Although in the embodiment described and as is preferred the feeder head is provided with the drive belts 30, other drive mechanisms could of course be employed, for example individually powered and sprung rollers.

To obtain best results with drive belts and in particular to ensure that workstock is held against a fence such as in commonly associated with a circular saw it has been found desirable that along a part of their length first to engage workstock the belts 30 should be set at an angle so as to direct workstock into contact with the fence. A suitable angle for this purpose is of the order of $\frac{1}{2}$ to $1\frac{1}{2}°$ towards the fence and the proportion of the length of the belts so angled may be approximately a first third of their length, such as for example in the embodiment described the length extending between the drive wheel 28 and the adjacent roller 31. The remainder of the length of the belts is advantageously set at an angle of approximately $\frac{1}{2}°$ in the same sense as the first parts thereof.

What is claimed is:

1. A device for feeding workstock to a saw blade or like power tool, comprising friction drive means adapted to engage a surface of the workstock to propel the same, means mounting the said drive means for a range of movement in a direction to accommodate workstock the dimensions of which vary in that direction, and means comprising a gas spring to hold the said drive means in any selected position within the said range of movement and resiliently to bias the same against movement away from that position, said gas spring including a valve system which is operable at least to reduce the bias to facilitate selected adjustment of the drive means, and which is closable to hold said drive means in a substantially fixed orientation throughout the said range of movement.

2. A device as claimed in claim 1 in which said gas spring comprises a gas-filled cylinder and a piston movable within that cylinder, and said valve system comprises means connecting opposite ends of said cylinder and a valve in said connecting means, opening of said valve putting said opposite ends of said cylinder into communication.

3. A device as claimed in claim 1 in which provision is made to effect lateral adjustment of the drive means only when the same are positioned clear of said tool.

4. A device as claimed in claim 1 in which the drive means include a parallel pair of driven belts arranged to engage the workstock.

5. A device as claimed in claim 4 in which the drive means is arranged to be adjusted between at least two positions, one in which the drive belts are located to one side of a saw blade and a second position in which they straddle the same.

6. A device as claimed in claim 4 in which along a part of their length first to engage workstock the belts are set at an angle so as in use to direct workstock into contact with a fence associated with the saw blade.

7. A device as claimed in claim 7 in which the angle is of the order or $\frac{1}{2}$ to $1\frac{1}{2}°$ to the direction in which the workstock is to be propelled.

8. A device as claimed in claim 7 in which approximately a first third of the length of the belts is set at the said angle.

9. A device as claimed in claim 8 in which the remainder of the length of the belts is set at an angle of approximately $\frac{1}{2}°$ to the direction of travel and in the same sense as the first parts of the belts.

10. A device as claimed in claim 1 for use in conjunction with a circular saw having a bench on which the drive means are mounted in which the means mounting the drive means comprise an arm arranged for rotation about an axis parallel to the axis of rotation of the saw, the drive means are pivotally secured to the arm and in which the means for automatically maintaining the drive means in a substantially fixed orientation comprise a parallelogram linkage system.

11. A device as claimed in claim 10 in which a gas spring is provided to act on the parallelogram linkage system so as to hold the drive means and resiliently to bias the same.

12. A device as claimed in claim 10 in which a motor and transmission means for powering the drive means are mounted for rotation about an axis parallel to the axis of rotation of the arm, the whole device being coupled for rotation with the motor and transmission.

13. A device as claimed in claim 13 in which the whole device is slidable along the first mentioned axis to effect lateral adjustment of the drive means, the device being lockable at predetermined positions along the said axis.

* * * * *